US008919442B2

(12) United States Patent
Hailey, Jr.

(10) Patent No.: US 8,919,442 B2
(45) Date of Patent: Dec. 30, 2014

(54) METHOD FOR COATING A FILTER MEDIUM OF A SAND CONTROL SCREEN ASSEMBLY

(75) Inventor: Travis Thomas Hailey, Jr., Sugar Land, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 714 days.

(21) Appl. No.: 12/852,630

(22) Filed: Aug. 9, 2010

(65) Prior Publication Data

US 2012/0034377 A1 Feb. 9, 2012

(51) Int. Cl.
*B05D 5/00* (2006.01)
*E21B 43/04* (2006.01)

(52) U.S. Cl.
CPC ..... *E21B 43/04* (2013.01)
USPC ..... 166/296; 166/227

(58) Field of Classification Search
USPC ..... 427/244, 154–156; 166/227, 230, 278, 166/296; 210/506–509
See application file for complete search history.

(56) References Cited

U.S. PATENT DOCUMENTS 4,202,411 A * 5/1980 Sharp et al. ..... 166/244.1
4,239,084 A 12/1980 Sharp et al.
6,394,185 B1 5/2002 Constien
6,831,044 B2 12/2004 Constien
7,204,316 B2 4/2007 Dusterhoft et al.
7,360,593 B2 * 4/2008 Constien ..... 166/227
2004/0261993 A1 * 12/2004 Nguyen ..... 166/276
2008/0000636 A1 * 1/2008 Misselbrook ..... 166/276
2008/0182762 A1 * 7/2008 Huang et al. ..... 507/213

FOREIGN PATENT DOCUMENTS

GB 2365043 2/2002

OTHER PUBLICATIONS

Kuredux technical specification, no date.*
PetroGuard Advanced Mesh Screen, 2007.
Coronado et al.; "Next-generation sand screen enables drill-in sandface completions"; Offshore; Dec. 2009; pp. 54-56.

* cited by examiner

*Primary Examiner* — Alex A Rolland
(74) *Attorney, Agent, or Firm* — Lawrence R. Youst

(57) ABSTRACT

A method for coating a filter medium (110) of a sand control screen assembly (100). The method includes providing a sand control screen assembly (100) having a filter medium (110), the filter medium (110) having pores therein, flowing a slurry containing particles through the filter medium (110) of the sand control screen assembly (100) and bridging the particle across the pores to form a particle coating (116) on the filter medium (110), thereby protecting of the filter medium (110) during installation, enabling transportation of reactive materials to a desired wellbore location and enabling circulation of fluid through the sand control screen assembly (100).

4 Claims, 6 Drawing Sheets

METHOD FOR COATING A FILTER MEDIUM OF A SAND CONTROL SCREEN ASSEMBLY

TECHNICAL FIELD OF THE INVENTION

This invention relates, in general, to equipment utilized in conjunction with operations performed in subterranean wells and, in particular, to a method for coating a filter medium of a sand control screen assembly via particle deposition.

BACKGROUND OF THE INVENTION

Without limiting the scope of the present invention, its background will be described in relation to sand control screen assemblies operating in a wellbore that traverses a subterranean hydrocarbon bearing formation, as an example.

During drilling and construction of wellbores that transverse hydrocarbon bearing formations, it is oftentimes desirable to form a filter cake on the face of the formation to minimize damage to the permeability thereof. The filter cake often comprises an acid-soluble component (e.g., a calcium carbonate bridging agent) and a polymeric component (e.g., starch and xanthan). Before desirable fluids, such as hydrocarbons, may be produced from the formation, the filter cake generally is removed.

In one method of removal, a treatment fluid such as an acid or a fluid operable to react with an acid generating compound may be pumped downhole to remove the filter cake. It has been found, however, that this type of procedures may involve expensive additional trips in and out of the wellbore. For example, in completions including sand control screens, it may be necessary to trip a service tool assembly in and out of the well to perform the treatment operation. In such installations, the service tool assembly may permit fluid to be circulated through the sand control screens, potentially plugging or clogging the sand control screens. Alternatively, the service tool assembly may include a washpipe that is run inside and to the end of the sand control screens so that most of the fluid is circulated around the sand control screens. In these installations, however, the cost and time required to run the washpipe is undesirable.

In addition, during the installation of sand control screens, the filter media may be exposed to intense and adverse conditions that may degrade the mechanical integrity of the filter media. For example, fluid circulation through the filter media caused by the movement of the sand control screens downhole as well as contact between the sand control screens and the wellbore in long horizontal or deviated open hole completions may damage or plug the sand control screens as they are run downhole.

Accordingly, a need has arisen for a sand control screen that is operable to allow circulation of fluid therethrough without the need for additional trips into the well. A need has also arisen for such a sand control screen that is not susceptible to damage during installation. Further, a need has arisen for such a sand control screen that is operable to transport a treatment component to a desired location downhole.

SUMMARY OF THE INVENTION

The present invention disclosed herein is directed to an improved method of coating a filter medium of a sand control screen assembly wherein the coating is operable to transport a reactive material to a desired wellbore location. In addition, the method of coating a filter medium of the present invention provides improved protection to the components of a sand control screen assemblies during installation. Further, the method of coating a filter medium of the present invention enables fluid circulation through a sand control screen assembly.

In one aspect, the present invention is directed to a method for coating a filter medium of a sand control screen assembly. The method includes providing a sand control screen assembly having a filter medium, the filter medium having pores therein, flowing a slurry containing particles through the filter medium of the sand control screen assembly and bridging the particle across the pores to form a particle coating on the filter medium.

In the method, the filter medium may be selected from single or multi-layer mesh filter media, wire wrap filter media, depth filter media, prepacked filter media, surface filter media or the like. The method may also include forming a permeable layer with the particle coating, forming a substantially impermeable layer with the particle coating, forming a particle coating on an inner surface of the filter medium, forming a particle coating on an outer surface of the filter medium, forming a particle coating on both an inner surface and an outer surface of the filter medium, flowing a slurry containing heterogeneously sized particles, flowing a slurry containing substantially homogeneously sized particles, flowing a slurry containing reactive particles through the filter medium, flowing a slurry containing reactive polymer particles through the filter medium, flowing an aqueous slurry through the filter medium or flowing an non-aqueous slurry through the filter medium.

In certain embodiments, particles are selected from the group consisting of polylactic acid, polyglycolic acid, polyethylene terephthalate, syndiotactic poly(meso-) polylactic acid, hetereotactic (disyndiotactic) poly(meso-lactide), atactic poly(meso-lactide), aliphatic polyester, lactides, poly(lactide), glycolide, poly(glycolide), lactone, poly(e-caprolactone), poly(hydroxybutyrate), anhydride, poly(anhydride), poly(amino acid), esterase enzyme and any combinations, mixtures and copolymers thereof. In other embodiments, the particles are selected from the group consisting of magnesium chloride, magnesium oxide, magnesium carbonate and mixtures thereof.

In another aspect, the present invention is directed to a method for coating a filter medium of a sand control screen assembly. The method includes providing a sand control screen assembly having a base pipe with an internal flow path and a filter medium disposed externally thereof, the filter medium having pores therein, flowing a slurry containing particles outwardly from the internal flow path through the filter medium of the sand control screen assembly, bridging the particle across the pores of the filter medium and coating an inner surface of the filter medium with the particles.

In a further aspect, the present invention is directed to a method for coating a filter medium of a sand control screen assembly. The method includes providing a sand control screen assembly having a base pipe with an internal flow path and a filter medium disposed externally thereof, the filter medium having pores therein, flowing a first slurry containing particles inwardly through the filter medium into the internal flow path of the base pipe, bridging the particle of the first slurry across the pores to form a particle coating on an outer surface of the filter medium, flowing a second slurry containing particles outwardly from the internal flow path through the filter medium of the sand control screen assembly and bridging the particle of the second slurry across the pores to form a particle coating on an inner surface of the filter medium.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
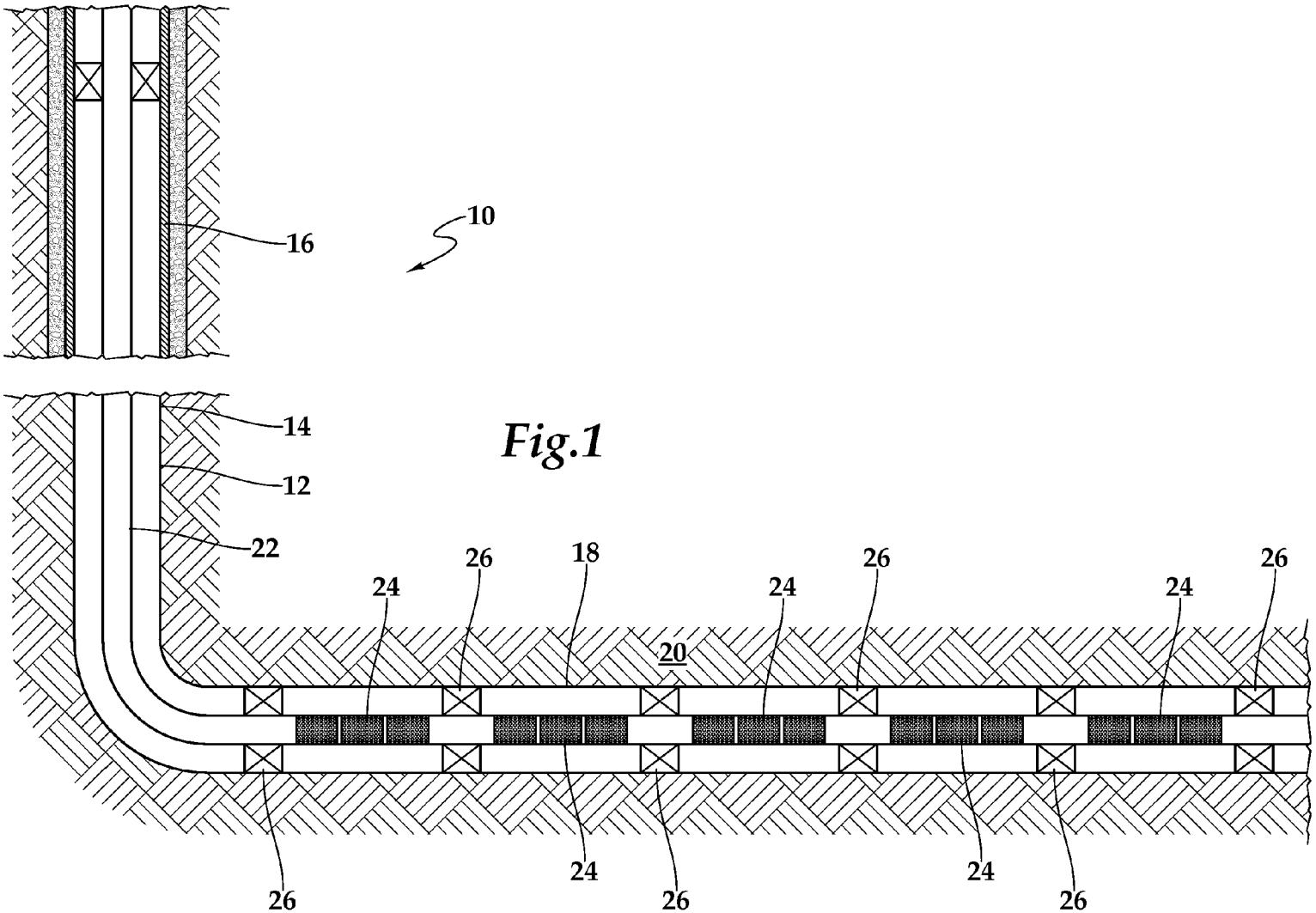
FIG. 1 is a schematic illustration of a well system operating a plurality of sand control screen assemblies according to an embodiment of the present invention.

Referring initially to FIG. 1, therein is depicted a well system including a plurality of sand control screen assemblies embodying principles of the present invention that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface. At its lower end, tubing string 22 is coupled to a completion string that has been installed in wellbore 12 and divides the completion interval into various production intervals adjacent to formation 20. The completion string includes a plurality of sand control screen assemblies 24, each of which is positioned between a pair of packers 26 that provides a fluid seal between the completion string and wellbore 12, thereby defining the production intervals.

Sand control screen assemblies 24 serve the primary function of filtering particulate matter out of the production fluid stream. In addition, the sand control screen assemblies of the present invention receive a particle coating prior installation to protect the filter media of sand control screen assemblies 24 during installation, to transport any reactive materials in the coating to the completion interval and to enable circulation of fluid through sand control screen assemblies 24 in certain implementations.

Even though FIG. 1 depicts sand control screen assemblies of the present invention in an open hole environment, it should be understood by those skilled in the art that the sand control screen assemblies of the present invention are equally well suited for use in cased wells. Also, even though FIG. 1 depicts one sand control screen assembly in each production interval, it should be understood by those skilled in the art that any number of sand control screen assemblies of the present invention may be deployed within a production interval without departing from the principles of the present invention. In addition, even though FIG. 1 depicts multiple production intervals separated by packers, it should be understood by those skilled in the art that the completion interval may have any number of production intervals including a single interval with a corresponding number of packers or no packers.

Even though FIG. 1 depicts the sand control screen assemblies of the present invention in a horizontal section of the wellbore, it should be understood by those skilled in the art that the sand control screen assemblies of the present invention are equally well suited for use in wells having other directional configurations including vertical wells, deviated wellbores, slanted wells, multilateral well and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
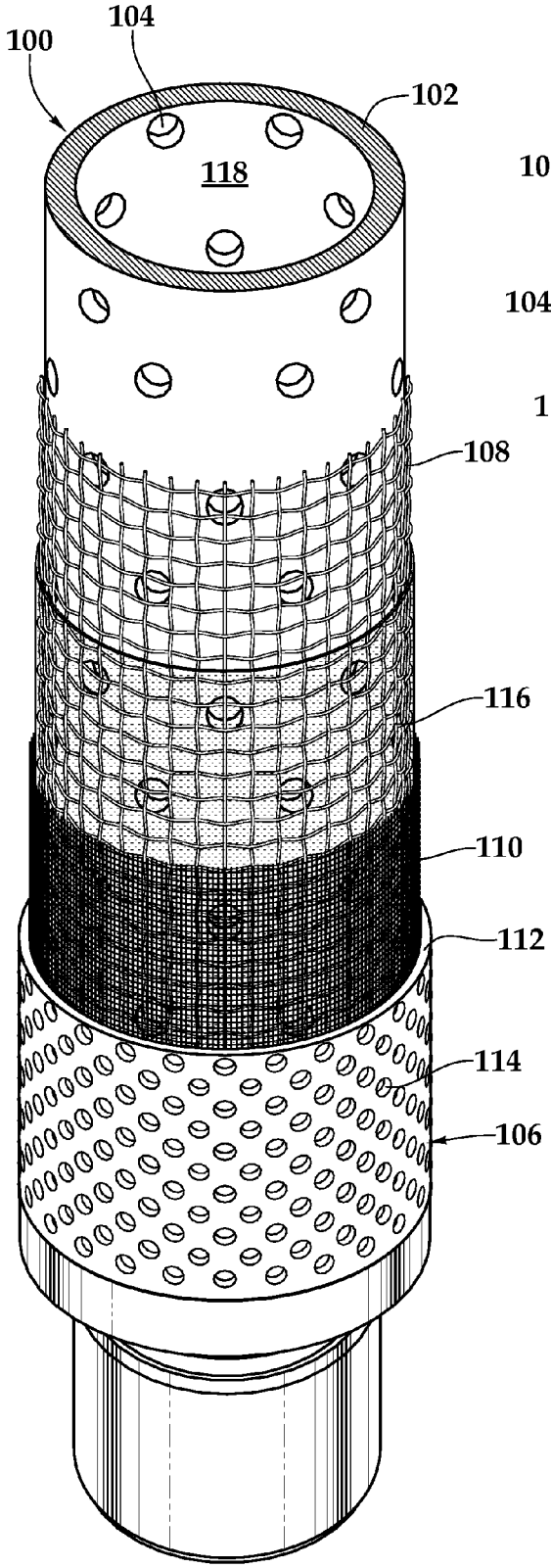
FIG. 2 is a side elevation view, partially cut away, of a sand control screen assembly having a filter medium with a particle coating according to an embodiment of the present invention.
Figure 3:
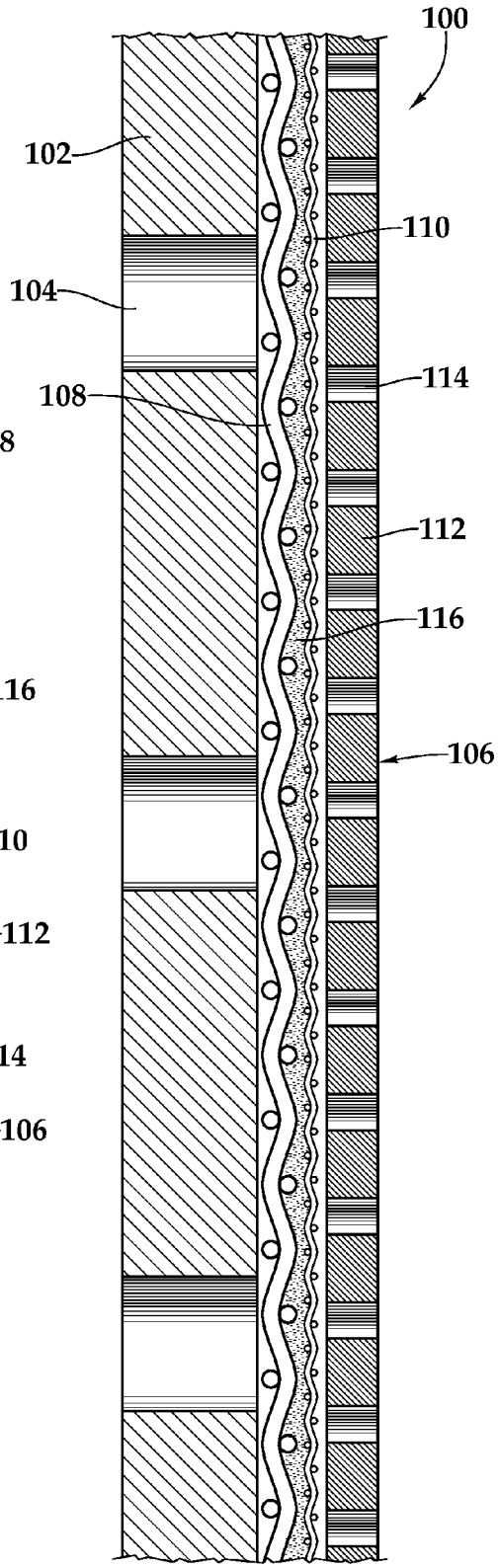
FIG. 3 is a cross sectional view of a sand control screen assembly having a filter medium with a particle coating according to an embodiment of the present invention.

Referring next to FIGS. 2-3, an embodiment of a sand control screen assembly of the present invention is depicted and generally designated 100. Sand control screen assembly 100 includes a base pipe 102 having a plurality of openings or perforations 104. Sand control screen assembly 100 has a screen jacket assembly 106 that is attached to base pipe 102 by welding, crimping or other suitable technique. Screen jacket assembly 106 including a multilayer mesh screen having a drainage layer 108, a filter medium or filtration layer 110 and an outer shroud 112 having a plurality of openings 114. Preferably, drainage layer 108 has a relative coarse wire mesh weave that provides standoff between filtration layer 110 and base pipe 102. In one embodiment, filtration layer 110 may be a plain Dutch weave or a twilled Dutch weave wire mesh material preferably having a uniform pore structure and a controlled pore size that is determined based upon formation properties.

Sand control screen assembly 100 also includes a particle coating or layer 116 that is formed according to the present invention. As described in greater detail below, particle coating 116 has been deposited within filtration layer 110 and on the inner surface of filtration layer 110 by a slurry deposition process wherein a slurry containing particles is pumped outwardly from the internal flow path 118 of base pipe 102 through filtration layer 110. The particles are sized such that they form bridges in the pores of filtration layer 110 to eventually fully or partially fill the void space and form a layer on the inner surface of filtration layer 110 that may partially or completely seal sand control screen assembly 100.

Figure 4:
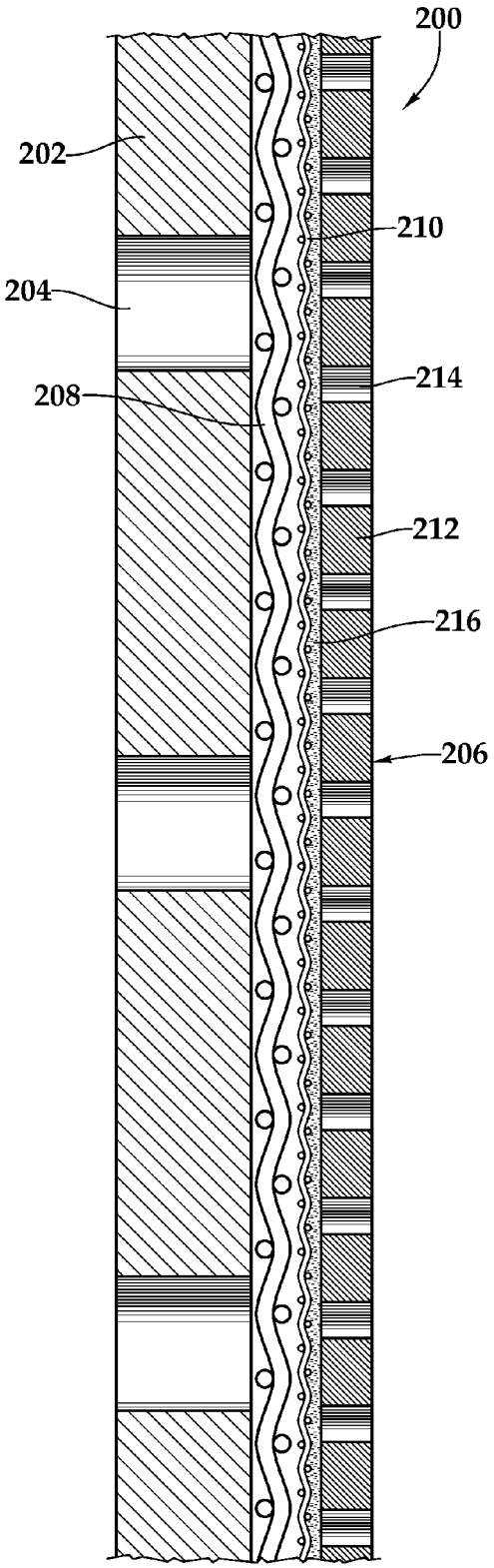
FIG. 4 is a cross sectional view of a sand control screen assembly having a filter medium with a particle coating according to an embodiment of the present invention.

Referring now to FIG. 4, an embodiment of a sand control screen assembly of the present invention is depicted and generally designated 200. Sand control screen assembly 200 includes a base pipe 202 having a plurality of openings or perforations 204. Sand control screen assembly 200 has a screen jacket assembly 206 that is attached to base pipe 202 by welding, crimping or other suitable technique. Screen jacket assembly 206 including a multilayer mesh screen having a drainage layer 208, a filter medium or filtration layer 210 and an outer shroud 212 having a plurality of openings 214. Sand control screen assembly 200 also includes a particle coating or layer 216 that is formed according to the present invention. As described in greater detail below, particle coating 216 has been deposited within filtration layer 210 and on the outer surface of filtration layer 210 by a slurry deposition process wherein a slurry containing particles is pumped inwardly through filtration layer 210 into the internal flow path of base pipe 202. The particles are sized such that they form bridges in the pores of filtration layer 210 to eventually fully or partially fill the void space and form a layer on the outer surface of filtration layer 210, thereby partially or completely sealing sand control screen assembly 200.

Figure 5:
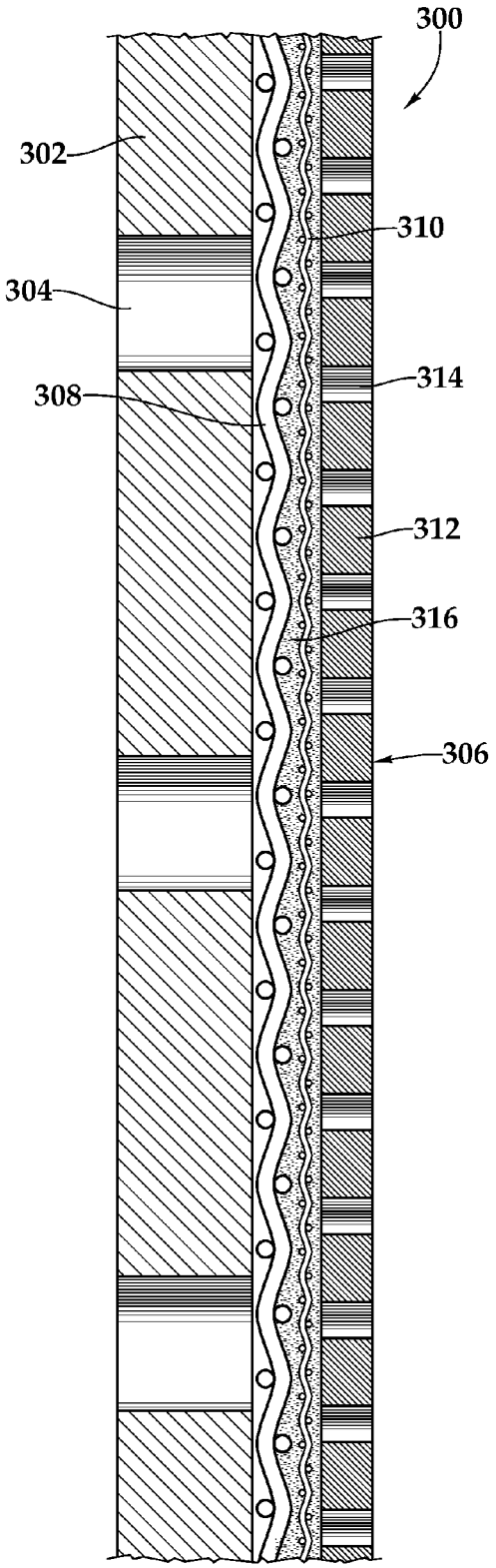
FIG. 5 is a cross sectional view of a sand control screen assembly having a filter medium with a particle coating according to an embodiment of the present invention.

Referring now to FIG. 5, an embodiment of a sand control screen assembly of the present invention is depicted and generally designated 300. Sand control screen assembly 300 includes a base pipe 302 having a plurality of openings or perforations 304. Sand control screen assembly 300 has a screen jacket assembly 306 that is attached to base pipe 302 by welding, crimping or other suitable technique. Screen jacket assembly 306 including a multilayer mesh screen having a drainage layer 308, a filter medium or filtration layer 310 and an outer shroud 312 having a plurality of openings 314. Sand control screen assembly 300 also includes a particle coating or layer 316 that is applied according to the present invention. Preferably, coating 316 has been deposited within filtration layer 310 and on the outer surface of filtration layer 310 by a slurry deposition process wherein a slurry containing particles is pumped inwardly through filtration layer 310 into the internal flow path of base pipe 302. In this embodiment, the particles are sized such that they form bridges in the pores of filtration layer 310 but only partially fill the void space to form a permeable layer on the outer surface of filtration layer 310. Thereafter, the inner portion of coating 316 is deposited within filtration layer 310 and on the inner surface of filtration layer 310 by a slurry deposition process wherein the slurry is pumped outwardly from the internal flow path of base pipe 302 through filtration layer 310 and the previously deposited portion of coating 316. Preferably, these particles are sized such that they form bridges in the remaining pore space of filtration layer 310 and the previously deposited portion of coating 316 to fully fill the void space and form the layer on the inner surface of filtration layer 310, thereby partially or completely sealing sand control screen assembly 300.

Figure 6:
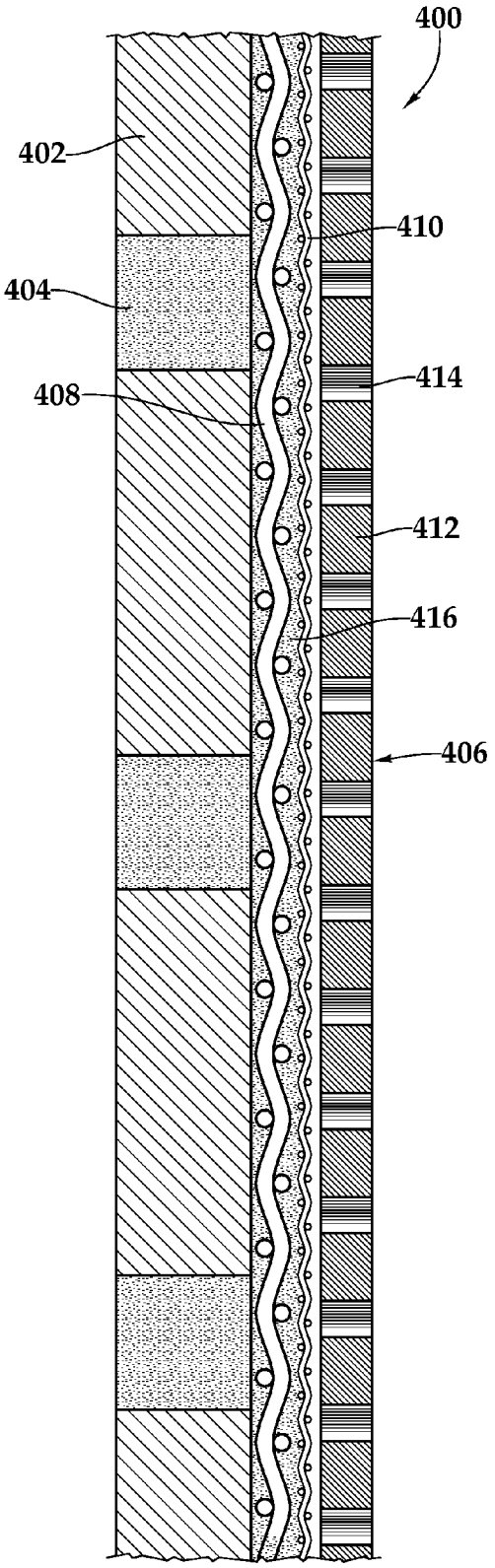
FIG. 6 is a cross sectional view of a sand control screen assembly having a filter medium with a particle coating according to an embodiment of the present invention.

Referring now to FIG. 6, an embodiment of a sand control screen assembly of the present invention is depicted and generally designated 400. Sand control screen assembly 400 includes a base pipe 402 having a plurality of openings or perforations 404. Sand control screen assembly 400 has a screen jacket assembly 406 that is attached to base pipe 402 by welding, crimping or other suitable technique. Screen jacket assembly 406 including a multilayer mesh screen having a drainage layer 408, a filter medium or filtration layer 410 and an outer shroud 412 having a plurality of openings 414. Sand control screen assembly 400 also includes a particle coating or layer 416 that is applied according to the present invention. Layer 416 has been deposited within filtration layer 410 and on the inner surface of filtration layer 410 by a slurry deposition process wherein a slurry containing particles is pumped outwardly through filtration layer 410 from the internal flow path of base pipe 402. As illustrated, the volume of particles that may be transported into the well is significant greater in this embodiment as layer 416 is allowed to build up into a thick layer during the deposition process. This embodiment may be preferred in installations that require a reactive material to be transported into the wellbore to act as a treatment component for a desired treatment process. If additional reactive materials are required for the treatment process, a sleeve containing reactive materials may be added to the interior of sand control screen assembly 400.

Figure 7:
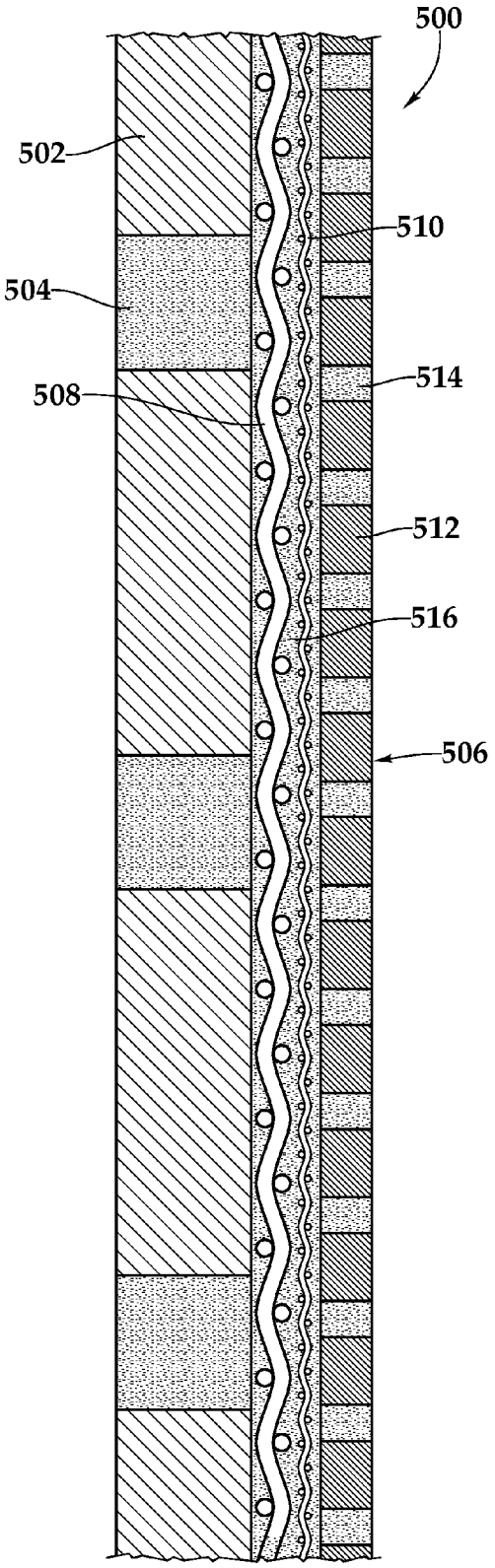
FIG. 7 is a cross sectional view of a sand control screen assembly having a filter medium with a particle coating according to an embodiment of the present invention.

Referring now to FIG. 7, an embodiment of a sand control screen assembly of the present invention is depicted and generally designated 500. Sand control screen assembly 500 includes a base pipe 502 having a plurality of openings or perforations 504. Sand control screen assembly 500 has a screen jacket assembly 506 that is attached to base pipe 502 by welding, crimping or other suitable technique. Screen jacket assembly 506 including a multilayer mesh screen having a drainage layer 508, a filter medium or filtration layer 510 and an outer shroud 512 having a plurality of openings 514. Sand control screen assembly 500 also includes a particle coating or layer 516 applied according to the present invention. Preferably, layer 516 is formed using a two phase deposition process similar to that discussed above with reference to FIG. 5, wherein the first deposition phase involves pumping the slurry containing particles inwardly through filtration layer 510 and the second deposition phase involves pumping the slurry containing particles outwardly through filtration layer 510. Alternatively, the two phase deposition process could first deposit particles on the inner surface then on the outer surface. Similar to FIG. 6, the volume of particles that may be transported into the well is significant greater in this embodiment as layer 516 is allowed to build up into a thick layer on both sides of filtration layer 510 during the deposition process.

Figure 8:
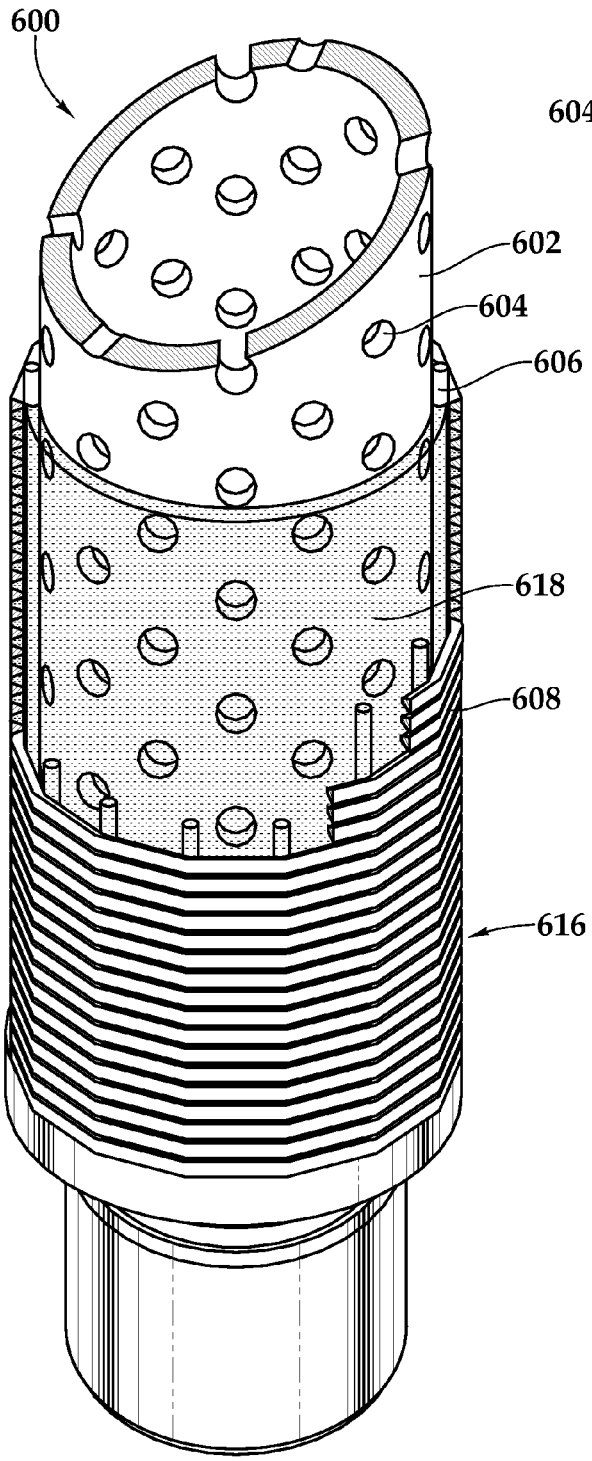
FIG. 8 is a side elevation view, partially cut away, of a sand control screen assembly having a filter medium with a particle coating according to an embodiment of the present invention.
Figure 9:
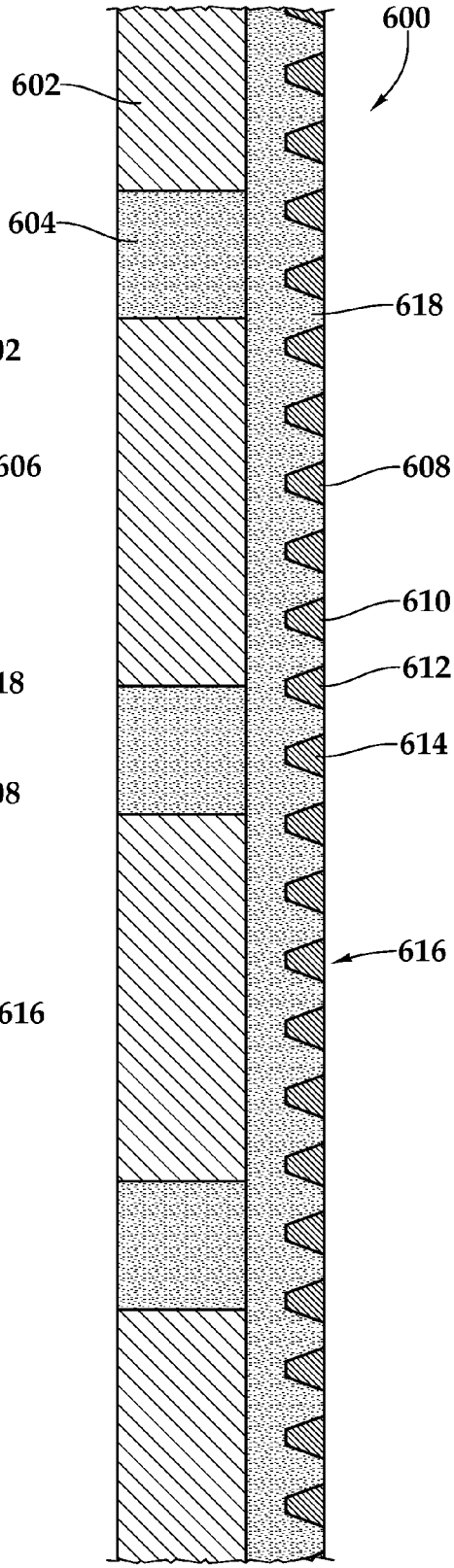
FIG. 9 is a cross sectional view of a sand control screen assembly having a filter medium with a particle coating according to an embodiment of the present invention.

Even though FIGS. 2-7 have described a sand control screen assembly having a multilayer mesh screen, the methods of the present invention may alternatively be used to seal other types of filter media. For example, FIGS. 8-9 depict an alternative embodiment of a sand control screen assembly of the present invention. Sand control screen assembly 600 includes a base pipe 602 having a plurality of openings 604. Sand control screen assembly 600 also includes a plurality of ribs 606 that are substantially symmetrically disposed or positioned about the axis of base pipe 602. Wrapped around and preferably welded to ribs 606 is a wrap on screen 608 that forms a plurality of turns such as turns 610, 612, 614 having gaps therebetween that represent to pores of sand control screen assembly 600. Together, ribs 606 and screen wire 608 form sand control screen jacket 616. Sand control screen jacket 616 is preferably attached to base pipe 602 by welding or other suitable technique. Sand control screen assembly 600 includes a particle coating or layer 618 formed according to the present invention. Layer 618 has been deposited within wrap on screen 608 and on the inner surface of wrap on screen 608 by a slurry deposition process wherein a slurry containing particles is pumped outwardly through wrap on screen 608 from the internal flow path of base pipe 602 bridging across the pores or gaps of wrap on screen 608 to form layer 618.

As discussed above, it may be desirable to be able to circulate fluid through the sand control screen during installation. In certain embodiments, the particle deposition process of the present invention is operable to seal the sand control screen to enable such circulation. In order to achieve the required sealing function, the proper particle size or sizes must be used. In general, for mesh filter elements, the minimum particle size in a homogeneous particle size mixture that will bridge the filter openings is about ⅓ of the pore size. For example, for a filter media with an opening size of nominally 300 microns, a desirable average particle size used in slurry that will bridge off on the filter media would be about 100 microns in diameter.

For a dense and impermeable coating of the particles on the filter media, a varied particle size is preferred, with a few particles larger than the opening size but a larger proportion of the particles smaller than the opening size, as the smaller particles will tend to plug the pore throats of the bed of larger particles. For example, a good mixture of particles that might be used to make a dense coating for a screen with 250 micron nominal opening size would be 5-10% of 600 micron particles, 20-25% 250 micron particles, 40-50% 100 micron particles, 20-25% micron particles, and 5-10% 25 micron particles. In addition, additives such as starches may be added to the slurry to make the coating less permeable to fluids. Other additives could be used to bind the particles in place to make the coating resistant to being displaced from the filter media by fluid flow axially through the screen control screen or any other differential pressure applied to the sidewall of the sand control screen.

If it is desired that a particle coating be permeable rather than impermeable, then the mixture of particles being used to coat the filter media should be more uniform and of larger average size. For example, a good particle mixture for a permeable coating for a screen with 250 micron nominal opening size would be 20-25% of 600 micron particles, with the balance being 250 micron particles. In this instance the use of an additive to bind the particles together when the particles are coated on the filter media might be preferred to keep the coating in place when the coating is stressed due to flow through the permeable coating. As explained above, a permeable coating is desirable when coatings are deposited on both sides of a filter media, for example a first coating being placed on one side of the filter media (e.g., the outer surface), and a second coating being placed on the inner surface. For the slurry coating process to work there must initially be flow through the filter media, and therefore it would be desirable for the first coating of this process to leave a permeable coating. The second coating of this process could be designed to leave either an impermeable or a permeable coating.

In certain embodiments, the particle may be formed from one or more reactive materials or a mixture of materials that are reactive together in a particular chemical environment. For example, the particles may include a mixture of magnesium chloride and magnesium oxide or a mixture of magnesium chloride, magnesium oxide and magnesium carbonate. In this embodiment, once the filter media is coated, as described herein, and the sand control screens are run downhole to the desired location, hydrochloric acid or other strong acid may be circulated in the well to dissolve the coating. In another embodiment, the particles may include one or more reactive polymers. The polymers may be rigid or semi-rigid and may preferably be thermoplastic polymers. The polymers may be selected to be reactive in certain downhole environments such as certain chemical environments, certain temperature environments or the like. For example, the polymers may be hydrolyzed over time by a downhole fluid, such as water. In one embodiment, the polymers include polylactic acid which is hydrolyzed with water downhole to form lactic acid that is useful for removing the undesirable compounds, such as filter cakes and the like, formed on the surface of the wellbore.

The reactive polymers may be linear polymers, non-linear polymers, cyclical polymers, oligomers, copolymers, inorganic polymers, natural organic polymers, synthetic organic polymers, macromolecules, homopolymers, low molecular weight polymers, high molecular weight polymers, water-soluble polymers, hydrolyzable polymers, and the like. Some exemplary reactive polymers include polylactic acid, polyglycolic acid, polyethylene terephthalate and combinations thereof. Polylactic acids may include isotactic poly(L-lactide) or poly(D-lactide), which may have melting points from about 338° F. to about 374° F. They may also include random optical copolymers, such as random levels of meso or D-lactide in L-lactide or D-lactic acid in L-lactic acid, which may have melting points of from about 266° F. to about 338° F. They may further include syndiotactic poly(meso-)polylactic acid, hetereotactic (disyndiotactic) poly(meso-lactide), atactic poly(meso-lactide) and the like.

Additionally, reactive polymers of the present invention may include aliphatic polyester, lactide, poly(lactide), glycolide, poly(glycolide), lactone, poly(e-caprolactone), poly (hydroxybutyrate), anhydride, poly(anhydride), poly(amino acid), esterase enzyme and any combination thereof.

The compositions of reactive polymers may be tailored for a particular implementation and may be selected to accommodate different downhole temperatures. For example, reactive polymers may be composed such that they are stable in relatively high wellbore temperatures for a relatively long period of time. In another example, reactive polymers may be composed such that they are stable at lower wellbore temperatures for a relatively long period of time but are unstable at higher wellbore temperatures.

To achieve the desire reaction rate at the desired temperature range, the reactive polymer may be formed from a single compound, polymer or material, or may be formed as a mixture or suspension of two or more compounds, polymers or materials. For example, in one embodiment, the reactive polymer may be a mixture or suspension of polylactic acid and polyglycolic acid. In another example, the reactive polymer may be a mixture or suspension of polylactic acid and a modified polylactic acid.

In one implementation, the reactive polymer is hydrolyzed in downhole conditions having high moisture content and high temperatures. Generally, the higher the moisture content and higher the temperature, the higher the rate of hydrolysis of the reactive polymer. A high moisture content may include the presence of aqueous solutions or water. Additionally, the reactive polymer may be autocatalytic or non-autocatalytic. These properties and conditions may further be used to determine a desired reactive polymer for use in a particular downhole environment.

Additionally, reducing the amount of residual monomers in the reactive polymers may slow down the rate of degradation or hydrolysis of the reactive polymer for autocatalyzing polymers. Further, for autocatalyzing polymers, the incorporation of buffering salts, such as $CaCO_3$ may further slow down the hydrolysis of certain polymers.

The rheological properties of a particular reactive polymer in certain downhole conditions may be considered when determining which reactive polymer to use. By tailoring a particular reactive polymer to the known characteristics of the downhole environment, a sand control screen assembly of the present invention can be sealed to enable circulation of fluid therethrough, to protect the filter medium during installation and to transport the reactive polymer to a desired wellbore location downhole. Thereafter, based upon the tailored degradation or hydrolysis rate of the reactive polymer in a known downhole environment, the release of the desired compounds, such as an acid, will coincide with a desired dissolution protocol of the filter cake. For example, it may be preferable to have the dissolution of the filter cake be in 7-10 days from installation of the sand control screen assemblies in the wellbore.

Figure 10:
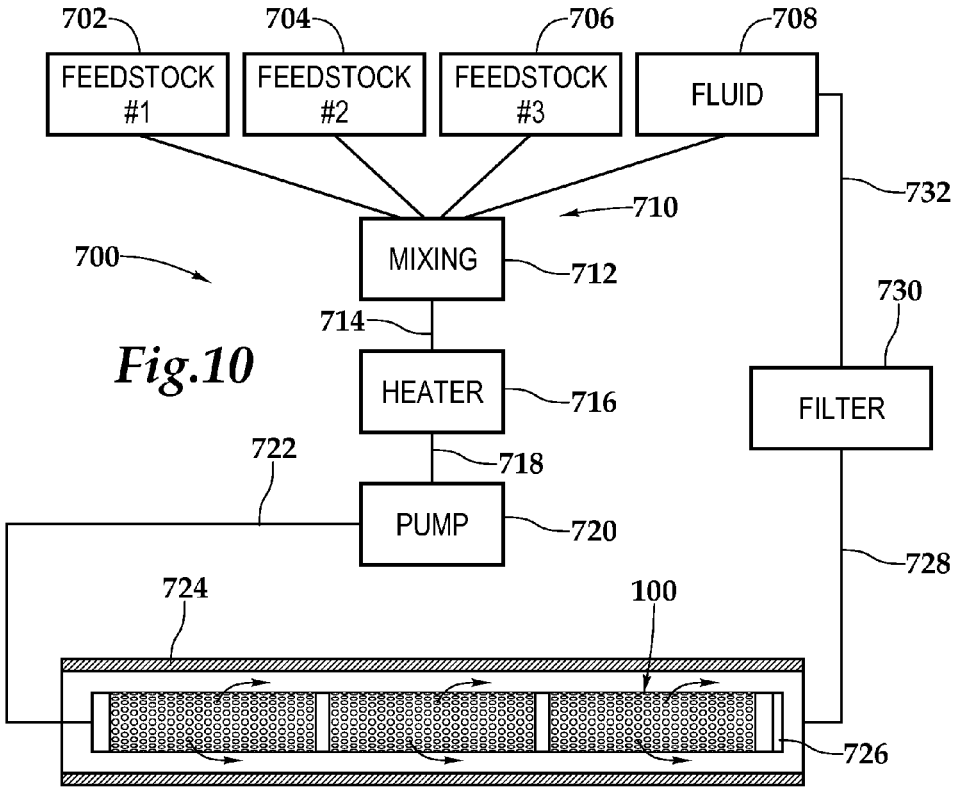
FIG. 10 is a block diagram of a system for particle deposition in a sand control screen assembly according to an embodiment of the present invention.

Referring now to FIG. 10, a slurry deposition system and method for coating filter media of a sand control screen assembly with a particle coating is schematically illustrated and generally designated 700. In general, slurry deposition system 700 may be used to deposit a particle layer on an inner surface and in the voids of a filter medium of sand control screen assembly such as sand control screen assembly 100 depicted in FIGS. 2 and 3. Slurry deposition system 700 includes a first feedstock container or vessel 702, a second feedstock container or vessel 704, and a third feedstock container or vessel 706. Feedstock containers 702, 704, 706 are for containing solid particles such as reactive particles including reactive polymer particles of the same or different chemical compositions and/or the same or different particle size. The particles may comprise a solid material that is mechanically or chemically reduced to the desired size for suspension in a slurry and deposition on the filter medium. In one example, the particles may be formed to the desired particle size by commonly known methods, such as grinding, milling, cutting and the like.

Feedstock containers 702, 704, 706 may be used to contain or hold different sized particles. For example, feedstock container 702 may contain particles having a relatively small nominal particle size such as 50 microns, feedstock container 704 may contain particles having a medium nominal particle size such as 150 microns and feedstock container 706 may contain particles having a relatively large nominal particle size such as 300 microns. Alternatively, feedstock containers 702, 704, 706 may contain homogeneously sized particles. As discussed above, the particle size or sizes are selected based upon the pore size of the filter medium and the desired porosity and permeability of the particle coating.

Slurry deposition system 700 further includes a fluid container or vessel 708 for containing the carrier fluid of the slurry. Fluid vessel 708 may contain an aqueous or non-aqueous fluid, liquid and/or solution to be mixed with the particles. Additionally, fluid vessel 708 may include a heating element for providing heat to the fluid contained within fluid vessel 708 prior to, during and after the particle deposition process.

Pipes or conduits 710 deliver the desired quantities of particles and fluid from feedstock containers 702, 704, 706 and fluid vessel 708 to a mixing vessel 712. Mixing vessel 712 may contain any known types of agitation, stirring, or other mechanical elements for providing turbulence or fluid action for mixing the slurry. Additionally, mixing vessel 712 may include a heating element for providing additional or constant heat to the slurry. Once the particles are properly suspended, the slurry may be pumped to an optional heater 716 via a conduit 714.

A pump 720 is in fluid communication with heater 716 via conduit 718. Pump 720 pumps the slurry through conduit 722 into one end of sand control screen assembly 100. Sand control screen assembly 100 is supported in a semi-sealed or sealing housing 724. As illustrated, the slurry is pumped into the internal flow path of base pipe 102 of sand control screen assembly 100 and flows through perforations 104 of base pipe 102, drainage layer 108, filter medium 110 and openings 114 of outer shroud 112 as shown by the arrows. A plug 726 prevents fluid from escaping out the end of sand control screen assembly 100. As the slurry is flowing through these elements, the particles of the slurry bridge across the pores of filter medium 110. As the bridging action continues and a layer of particle builds up, permeability through sand control screen assembly 100 may decrease, which may be indicated by pressure increases in the process. While the particles are being deposited, the fluid flows out of sand control screen assembly 100 as shown by the arrows, where it is collected in housing 724 and then pumped via conduit 728 to an optional filter 730. Filter 730 may filter any remaining particles out of the slurry for recycling at a later stage or particles may be allowed to bypass filter 730 during the deposition process. The fluid from filter 730 is then pumped back to fluid vessel 708 via conduit 732. The process is continued until a desired quantity of particles has been deposited within sand control screen assembly 100.

Figure 11:
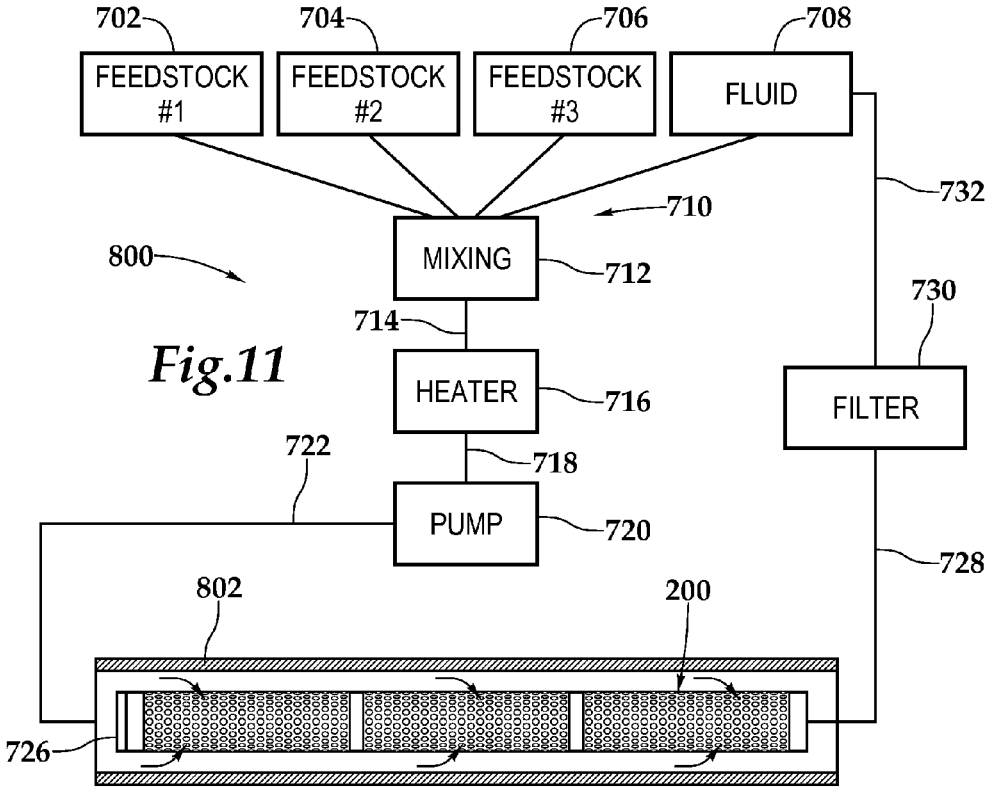
FIG. 11 is a block diagram of a system for particle deposition in a sand control screen assembly according to an embodiment of the present invention.

Referring now to FIG. 11, a slurry deposition system and method for coating filter media of a sand control screen assembly with a particle coating is schematically illustrated and generally designated 800. In general, slurry deposition system 800 may be used to deposit the particle layer onto an outer surface and within the void space of a filter medium of a sand control screen assembly such as sand control screen 200 depicted in FIG. 4.

Slurry deposition system 800 may include feedstock containers 702, 704, 706, fluid vessel 708, mixing vessel 712, heater 716, pump 720, and filter 730 as described above with reference to slurry deposition system 700. Additionally, the operation of these units and processes for slurry deposition system 800 may be similar to that described for slurry deposition system 700.

In addition to the above, slurry deposition system 800 includes a housing 802 that is sealed. In this embodiment, conduit 722 feeds the slurry into one end of the sealed housing 802 such that the slurry is pressurized within housing 802. In this manner, as shown by the arrow, the slurry flows first through openings 214 of shroud 212, then through filter medium 210, then through drainage layer 208 and finally through perforations 204 of base pipe 202. This system and method preferably deposits the particle on the outer surface of filter medium 210.

A plug 726 prevents fluid from escaping out the end of sand control screen assembly 200. As the slurry is flowing through these elements, the particles of the slurry bridge across the pores of filter medium 210. As the bridging action continues and a layer of particles builds up, permeability through sand control screen assembly 200 may decrease, which may be indicated by pressure increases in the process. While the particles are being deposited, the fluid flows out of sand control screen assembly 200 into conduit 728 to a filter 730. The process is continued until a desired quantity of particles has been deposited within sand control screen assembly 200.

In another embodiment, one of housing 724 or housing 802 may be modified to also include the functionality of the other, such that deposition of particles may occur on both sides of the filter medium with one machine. Further, both housing 724 and housing 802 may be used in tandem or sequentially such that deposition of particles may occur on both sides of the filter medium. In such operations, it may be preferable to form the particle layer on the outer surface of the filter medium before forming the particle layer on the inner surface of the filter medium. In this embodiment, the outer deposition may utilize larger sized particles such that the resulting particle layer will be sufficiently permeable to be flowed through during the inner layer deposition.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A method for coating a filter medium of a sand control screen assembly comprising:

providing a sand control screen assembly having a base pipe with an internal flow path and a filter medium disposed externally thereof, the filter medium having pores therein;

flowing a first slurry containing particles of a first size inwardly through the filter medium into the internal flow path of the base pipe;

bridging the particles of the first slurry across the pores to form a fluid permeable particle coating layer on an outer surface of the filter medium;

flowing a second slurry containing particles of a second size that are smaller than the particles of the first size outwardly from the internal flow path through the filter medium of the sand control screen assembly; and bridging the particles of the second slurry across the pores to form a fluid impermeable particle coating on at least an inner surface of the filter medium.

2. The method as recited in claim 1 wherein the flowing steps further comprise flowing a slurry containing reactive particles through the filter medium.

3. The method as recited in claim 1 wherein the flowing steps further comprise flowing a slurry containing reactive polymer particles through the filter medium.

4. The method as recited in claim 1 wherein the particles of the first and second slurries are selected from the group consisting of polylactic acid, polyglycolic acid, polyethylene terephthalate, syndiotactic poly(meso-) polylactic acid, hetereotactic (disyndiotactic) poly(meso-lactide), atactic poly (meso-lactide), aliphatic polyester, lactides, poly(lactide), glycolide, poly(glycolide), lactone, poly(e-caprolactone), poly(hydroxybutyrate), anhydride, poly(anhydride), poly (amino acid), esterase enzyme and any combinations, mixtures and copolymers thereof.

* * * * *